US005311263A

United States Patent [19]

Suzuki et al.

[11] Patent Number: 5,311,263

[45] Date of Patent: May 10, 1994

[54] DEVELOPING APPARATUS FOR IMAGE FORMING EQUIPMENT USING DEVELOPER CARRIER FOR FORMING MICROFIELDS

[75] Inventors: Koji Suzuki, Yokohama; Naoki Iwata, Tokyo; Yuichi Ueno; Shigekazu Enoki, both of Kawasaki; Junko Tomita, Tokyo, all of Japan

[73] Assignee: Ricoh Company, Ltd., Tokyo, Japan

[21] Appl. No.: 977,172

[22] Filed: Nov. 16, 1992

[30] Foreign Application Priority Data

Nov. 14, 1991 [JP] Japan ..... 3-326341

[51] Int. Cl.[5] ..... G03G 15/08

[52] U.S. Cl. ..... 355/251; 118/651; 118/658; 355/261

[58] Field of Search ..... 355/251, 253, 259, 261, 355/262; 118/648, 651, 656, 657, 661

[56] References Cited

U.S. PATENT DOCUMENTS

| | | | |
|---|---|---|---|
| 4,295,443 | 10/1981 | Kohyama | 118/657 |
| 4,538,898 | 9/1985 | Kanno et al. | 118/657 |
| 4,561,381 | 12/1985 | Kaneko et al. | 355/253 X |
| 4,564,285 | 1/1986 | Yasuda et al. | 118/651 |
| 4,576,463 | 3/1986 | Sakamoto et al. | 355/253 |
| 4,788,570 | 11/1988 | Ogata et al. | 355/245 |
| 4,896,625 | 1/1990 | Sakamoto et al. | 118/657 |
| 5,172,169 | 12/1992 | Takashima et al. | 355/246 |
| 5,220,383 | 6/1993 | Enoki et al. | 355/246 |
| 5,239,344 | 8/1993 | Enoki et al. | 355/259 |
| 5,245,391 | 9/1993 | Suzuki et al. | 355/246 |

*Primary Examiner*—A. T. Grimley
*Assistant Examiner*—Robert Beatty
*Attorney, Agent, or Firm*—Oblon, Spivak, McClelland, Maier & Neustadt

[57] ABSTRACT

A developing apparatus for image forming equipment capable of insuring images with high resolution while preserving tonality. A developing sleeve is provided with conductive portions and insulative portions on its surface by knurling. A magnetic roller is accommodated in the sleeve to constitute a developing roller. A toner supply roller is held in contact with the developing sleeve. A doctor blade is disposed above and spaced apart by a predetermined distance from the developing sleeve and made of a magnetic material. Bias applying means applies an alternating voltage to the sleeve to effect reversal development.

2 Claims, 6 Drawing Sheets

DEVELOPING APPARATUS FOR IMAGE FORMING EQUIPMENT USING DEVELOPER CARRIER FOR FORMING MICROFIELDS

BACKGROUND OF THE INVENTION

1. Field of the Invention

The present invention relates to a developing apparatus incorporated in an electrophotographic copier, printer, facsimile transceiver or similar image forming equipment. More particularly, the present invention is concerned with a developing apparatus of the type depositing a developer on a developer carrier and transporting it to a developing position where the developer carrier faces an image carrier to thereby develop a latent image electrostatically formed on the image carrier.

2. Discussion of the Background

A developing apparatus of the type described is disclosed in, for example, Japanese Patent Publication No. 32375/1983 and includes an image carrier and a developer carrier located face-to-face at a developing position. An alternating electric field is generated in the developing position to repetitively transfer a developer from the developer carrier to the image carrier and from the image carrier to the developer carrier, thereby developing an electrostatic latent image formed on the image carrier. In this type of apparatus, the developer carrier is implemented as a cylindrical nonmagnetic sleeve accommodating a permanent magnet in the form of a roll. A magnetic toner contacts such a developer carrier due to the force of the magnet and gravity. The toner is charged to a predetermined polarity by friction thereof with the surface of the nonmagnetic sleeve. As the toner retained on the sleeve by the force of the magnet reaches a position where a magnetic blade faces the sleeve at a predetermined spacing, it is regulated by the blade to form a layer which is about 70 μm.

The problem with the conventional apparatus described above is that the magnetic toner cannot be sufficiently charged since the toner contacting the nonmagnetic sleeve due to the force of the magnet and gravity is simply charged by friction in contact with the sleeve being rotated. For example, the amount of charge on the toner forming the second layer and successive layers as counted from the surface of the sleeve is extremely small. The toner with a comparatively small amount of charge easily flies toward the image carrier due to the alternating electric field and, therefore, enhances the tonality of an image. However, such a toner is apt to contaminate the background of the image carrier to thereby thicken lines of an image and lower the resolution.

SUMMARY OF THE INVENTION

It is, therefore, an object of the present invention to provide a developing apparatus for image forming equipment capable of producing desirable images with high resolution while preserving tonality.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
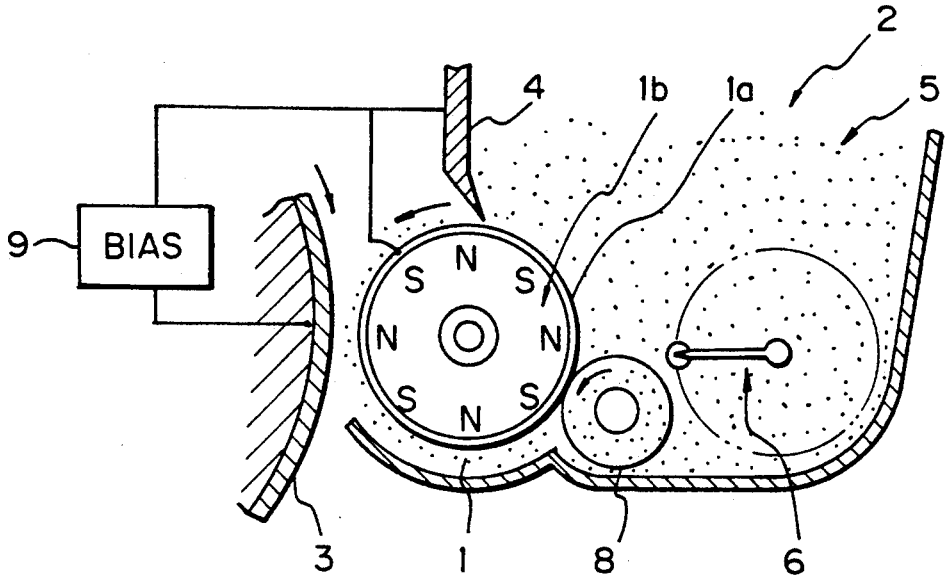
FIG. 1 is a section showing the general construction of a developing apparatus embodying the present invention.

Referring to FIG. 1 of the drawings, a developing apparatus embodying the present invention is shown and generally designated by the reference numeral 2. As shown, the developing device 2 has a casing formed with an opening in a portion thereof which faces a photoconductive drum 3. A developing roller 1 is disposed in the casing and partly exposed to the outside through the opening. The developing roller 1 is implemented as a sleeve 1*a* made of aluminum or similar nonmagnetic and conductive material. A magnetic roller 1*b* is accommodated in the sleeve 1*a* and provided with magnetic poles, as illustrated. While the magnetic roller 1*b* is fixed in place, the sleeve 1*a* is rotated counterclockwise, as indicated by an arrow in the figure, by a drive mechanism, not shown. The developing roller 1 is supported in the casing at a predetermined spacing from the drum 3. The distance between the roller 1 and the drum 3 ranges from 30 μm to 500 μm, preferably 50 μm to 250 μm, so that the sleeve 1*a* may substantially not contact the drum 3. In this configuration, an excessive load as would be required to develop an electrostatic latent image by holding the sleeve 1*a* in contact with the drum 3 is not needed, allowing a miniature drive motor to suffice.

A toner tank 5 is defined in the casing and provided with an agitator 6 therein. As the agitator 6 is rotated clockwise, as indicated by an arrow in the figure, it moves a magnetic toner, or simply toner, toward the sleeve 1*a* while agitating the toner due to the resistance of the edge thereof.

A toner supply roller 8 is located at the right-hand side of and in contact with the sleeve 1*a*. This roller 8 is made of sponge produced by causing urethane rubber to foam, or implemented as a brush of polyester or tetraethylene fluoride resin fibers. The roller 8 supplies the toner driven by the agitator 6 to the sleeve 1*a* by rubbing it against the surface of the sleeve 1*a* in the forward or reverse direction. At the same time, the roller 8 scrapes off the toner remaining on the sleeve 1*a* after development.

A doctor blade 4 is disposed above the sleeve 1*a* and spaced apart from the latter by a predetermined distance. Made of a magnetic material, the doctor blade 4 regulates the toner layer carried on and transported by the sleeve 1*a* to a predetermined thickness. The doctor blade 4 and the magnetic poles of the magnetic roller 1*b* generate magnetic fields therebetween. As the toner supply roller 8 is rotated, the doctor blade 4 regulates the thickness of the toner layer on the sleeve 1*a* at the position where it faces the sleeve 1*a*. If desired, the doctor blade 4 may be replaced with a roller or a belt made of a magnetic material.

The sleeve 1*a* and doctor blade 4 are held in electrical conduction. Bias applying means 9 applies a bias for development to the conductive support member of the drum 3, as will be described specifically later.

A bias may be applied to the toner supply roller 8 in such a manner as to generate electric fields between the roller 8 and the sleeve 1*a* which tend to urge the toner of predetermined polarity toward the sleeve 1*a*.

In the above construction, the toner in the toner tank 5 is driven toward the toner supply roller 8 by the agitator 6. Then, the toner is electrostatically retained on the surface of the sleeve 1*a* by being charged due to the friction of the roller 8 and sleeve 1*a*. As the sleeve 1*a* is rotated, the toner is transported to a developing position where the drum 3 and sleeve 1*a* face each other, while being regulated in thickness by the doctor blade 4. At the developing position, the toner is transferred from the sleeve 1*a* to a latent image electrostatically formed on the drum 3 in an amount matching the latent image and under the application of a predetermined bias voltage.

Figure 2:
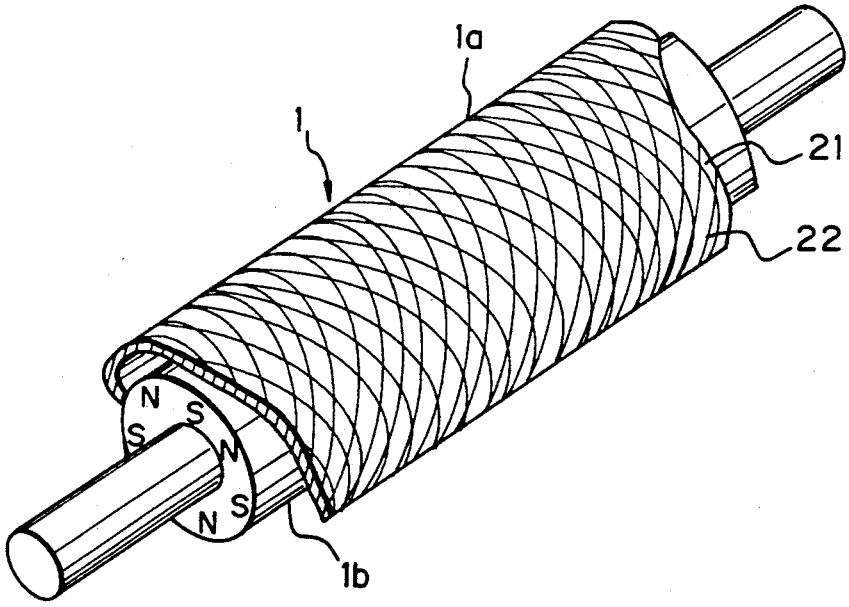
FIG. 2 is a perspective view of a developing roller included in the embodiment.
Figure 3:
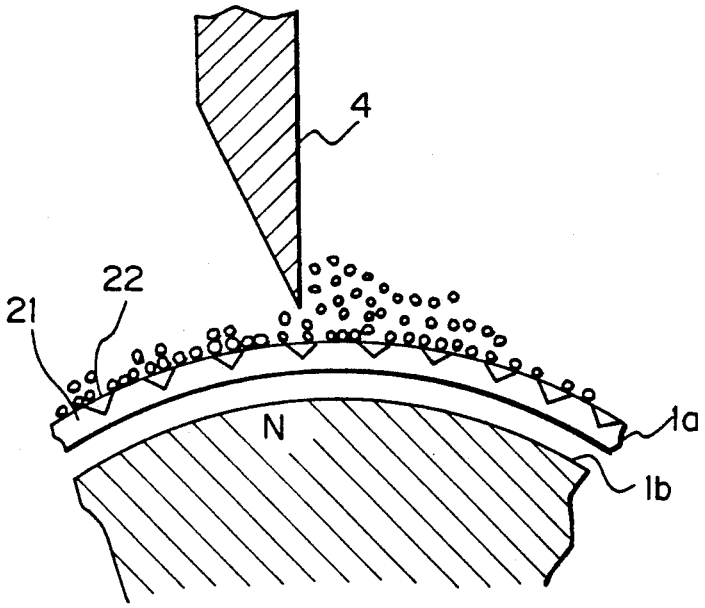
FIG. 3 is an enlarged section of the developing roller shown in FIG. 2.

In the illustrative embodiment, the surface of the sleeve 1*a* is configured such that two different kinds of portions each having a particular resistance or a particular dielectric constant appear in a regularly or irregular distribution. FIG. 2 shows a specific configuration of the sleeve 1*a* while FIG. 3 shows the surface of the sleeve 1*a* in an enlarged section. As shown, the sleeve 1*a* is produced by knurling the surface of a base in a lattice configuration, and then filling the resulting grooves with polycarbonate, acryl, polyester, tetraethylene fluoride or a similar dielectric resin belonging to a charge sequence whose polarity is opposite to the polarity of the toner. As a result, the sleeve 1*a* has on the surface thereof insulative portions 22 arranged in a lattice and conductive portions 21 constituted by the base.

Figure 5A:
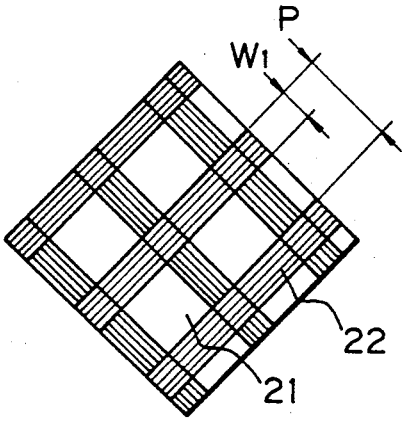
FIGS. 5A–5C are enlarged views each showing a specific configuration of the surface of the sleeve.
Figure 5B:
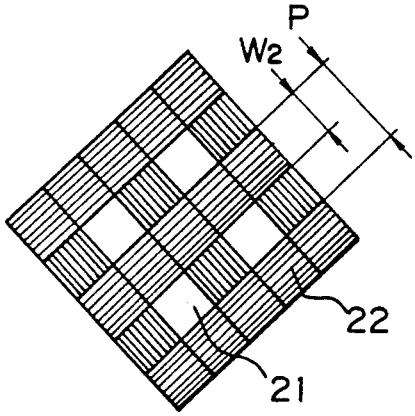
Figure 5C:
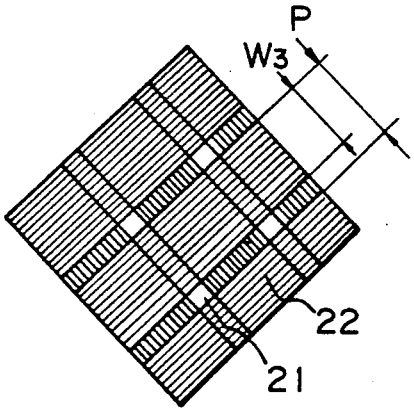

FIGS. 5A–5C each show a particular surface configuration of the sleeve 1*a* in which grooves inclined 45 degrees to the direction of movement of the sleeve surface are formed by knurling, and the insulative portions 22 and conductive portions 21 are formed by the above-stated step. In FIGS. 5A–5C, the knurling pitch P is 0.3 mm, each insulative portion 22 has a width W1 of 0.075 mm, a width W2 of 0.015 mm or a width W3 of 0.225 mm, and the insulative portions 22 and conductive portions 21 exist together at a pattern pitch of 0.3 mm on the sleeve surface.

It is to be noted that the above-described method of forming the two different kinds of portions 21 and 22 is only illustrative and may be replaced with any other suitable method. Further, the inclination of the insulative portions 22 to the circumferential direction is not limited to 45 degrees and may preferably be selected in a range of from 30 degrees to 60 degrees.

Figure 4:
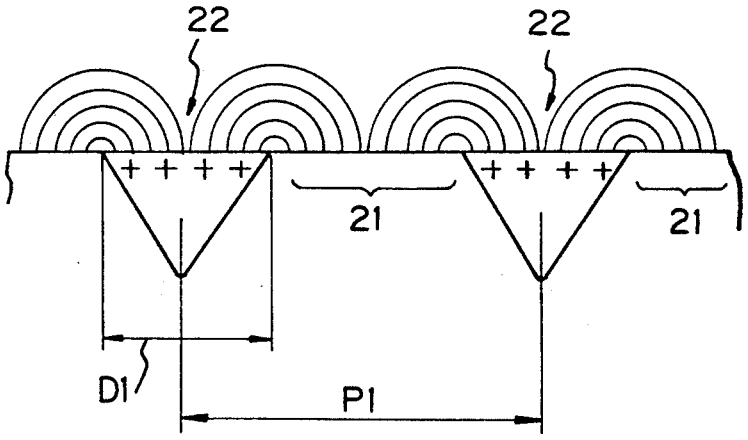
FIG. 4 shows electric lines of force representative of microfields developed in the vicinity of insulative portions appearing on the surface of a sleeve which forms part of the developing roller.

The insulative portions 22 are 30 μm to 2000 μm, preferably 50 μm to 1000 μm, in terms of mean diameter. Assuming that the insulative portions 22 each have a circular shape, the diameter D1 thereof, FIG. 4, is selected to be 30 μm to 2000 μm, preferably 100 μm to 400 μm, and the distance P1, FIG. 4, between the centers of nearby portions 22 is selected to set up a desirable balance. When the insulative portions 22 are rectangular, the shortest side of each portion 22 is selected to be about 30 μm to about 2000 μm. Likewise, when the insulative portions 22 are oval or oblong, the width of the shorter axis is selected to be about 30 μm to 2000 μm. This is also true with other possible shapes of the insulative portions 22. The insulative portions 22 may occupy 50% to 80%, desirably 65% to 75%, of the entire surface of the sleeve 1*a*. When the sleeve 1*a* is provided with such a structure, the toner can be frictionally charged when rubbed against the sleeve 1*a* by the toner supply roller 8 and then deposited in a sufficient amount on the surface of the sleeve 1*a*.

Specifically, the insulative portions 22 of the sleeve 1*a* are charged to a positive polarity opposite to the polarity of the toner by the friction thereof with the toner supply roller 8. On the other hand, the toner being conveyed toward the sleeve 1*a* in contact with the surface of the toner supply roller 8 is charged to a negative polarity by friction. On reaching the sleeve 1*a*, the toner of negative charge is further negatively charged due to friction thereof with the sleeve 1*a*, particularly the insulative portions 22. As a result, the toner is electrostatically deposited on the surface of the sleeve 1*a*.

At this instant, the insulative portions 22 of the sleeve 1*a* are charged to a positive polarity. This, coupled with the fact that the conductive portions 21 adjoin the insulative portions 22, causes positive polarity to deposit only on the number of insulative portions 22. As a result, as shown in FIG. 4, closed electric fields are generated between the insulative portions 22 and the conductive portions 21, whereby a number of microfields are developed in the vicinity of the surface of the sleeve 1*a*. Specifically, as indicated by a number of arcuate lines in FIG. 4, electric lines of force extending from and returning to the sleeve 1*a* are formed in the space adjoining the surface of the sleeve 1*a*, generating microfields between the insulative portions 22 and the conductive portions 21.

Since each insulative portion 22 has an extremely small area, as stated earlier, each closed electric field is noticeably intensified by a fringing effect or peripheral field effect. Such closed electric fields cause the negatively charged toner to be strongly attracted by the insulative portions 22 and firmly retained on the sleeve 1*a* in a great amount.

A magnetic field is developed between the doctor blade 4 and the pole of the magnetic roller 1*b* to generate a magnetic force, while the microfields on the surface of the sleeve 1*a* exert electrostatic attraction. When the toner retained on the sleeve 1*a* is regulated by the doctor blade 4, only part of the toner having been sufficiently charged is retained on and transported by the sleeve 1*a* due to the balance between the above-mentioned magnetic force and the electrostatic attraction. The rest of the toner cannot pass through the gap between the doctor blade 4 and the sleeve 1*a* and is, therefore, removed by the blade 4 due to the short charge thereof. Consequently, toner particles with an intense charge, e.g., about 5 $\mu$C/g to 20 $\mu$C/g (preferably 7 $\mu$C/g to 15 $\mu$C/g) are allowed to reach the developing position.

Presumably, at the developing position, the bias from the bias applying means 9 acts on the microfields existing between the conductive portions 21 and the insulative portions 22 on the surface of the sleeve 1*a* and on the charged toner, exerting dynamic energy suitable for the development of an electrostatic latent image.

Specifically, the surface potential of the sleeve 1*a* differs from the insulative portions 22 to the conductive portions 21 since the former holds the above-stated charge while the latter does not hold it. More specifically, the surface potential of the insulative portions 22 is biased by a predetermined amount by the charge ascribable to the voltage from the bias applying means 9, while the surface potential of the conductive portions 21 is identical with the voltage from the bias applying means 9. It follows that the electric fields between the surface of the sleeve 1*a* and the drum 3 depend not only on to which of the image portions and non-image portions of the drum 3 they correspond, but also on to which of the insulative portions 22 and conductive portions 21 of the sleeve 1*a* they correspond. The toner existing on the insulative portions 22 is subjected to the charge deposited on the insulative portions 22 and, therefore, is prevented from depositing in an excessive amount. On the other hand, the toner existing on the conductive portions 21 tends to comparatively easily move to the drum 3. In addition, the conductive portions 21 serve to uniformize the image density by suppressing an edge effect.

The sleeve 1*a*, therefore, attains both of the characteristic of a developing roller having an insulative surface and the characteristic of a developing roller having a conductive surface. Specifically, a developing roller with an insulative surface is desirable in the reproducibility of lines and in tonality although the image density available therewith is low, but the reproducibility of lines and tonality decrease if the density is increased. A developing roller with a conductive surface produces a dense image whose solid portions are highly uniform due to the electrode effect thereof, but the reproducibility of lines and tonality are low.

The conductive portions 21 and insulative portions 22 existing together on the surface of the sleeve 1*a* eliminate the charge-up of the sleeve 1*a* and toner supply roller 8. This is presumably because the portions 22 charge the toner while the portions 21 discharge the toner supply roller 8, setting up a well-balanced charge distribution as a whole.

A more specific example of the illustrative embodiment will be described hereinafter.

In the specific example, the drum 3 was made of OPC. The drum 3 was applied with a surface potential of −900 V in the background and a potential of −100 V in the exposed portion. The sleeve 1*a* having the surface configuration shown in FIG. 5B was spaced apart from the drum 3 by a distance of 100 $\mu$m. The drum 3 and sleeve 1*a* were each rotated in the direction indicated by an arrow so as to effect reversal development. The insulative portions 22 of the sleeve 1*a* held a charge which set up a potential of +200 V with ground as a reference by being rubbed by the toner supply roller 8. In this condition, the insulative portions 22 caused a negatively charged toner to deposit thereon in an amount of about 1.0 mg/cm$^2$ to 1.2 mg/cm$^2$. The bias applying means 9 applied to the sleeve 1*a* a pulse voltage having a peak-to-peak (p-p) voltage of 1000 V, a maximum voltage of 0 V, a frequency of 500 Hz, and a duty ratio of 30% ($T_2/T_1$).

Figure 6A:
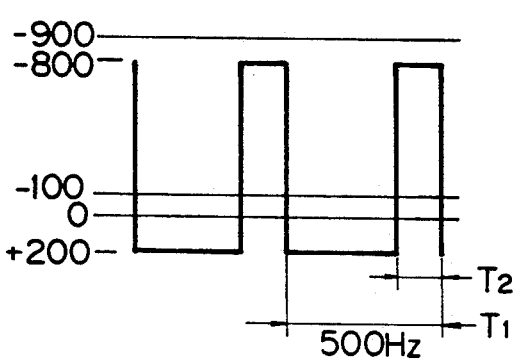
FIGS. 6A and 6B plot respectively the variation of potential on insulative portions included in the sleeve with respect to time and the variation of potential on conductive portions also included in the sleeve.
Figure 6B:
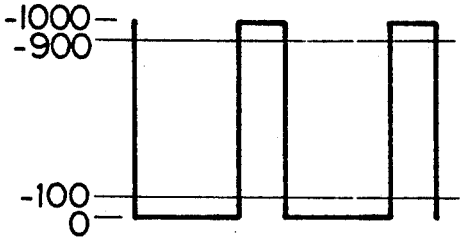

FIGS. 6A and 6B show the variations of the surface potential of the sleeve 1*a* with respect to time and using ground as a reference and are associated with the insulative portions 22 and the conductive portions 21, respectively. In these figures, the level of the surface potential of the background (−900 V) and that of the surface potential of the exposed portion (−100 V) of the drum 3 are indicated by horizontal lines. As the rectangular continuous line in FIG. 6A indicates, the surface potential of the insulative portions 22 is biased by +200 V by the charge ascribable to the voltage from the bias applying means 9. On the other hand, as FIG. 6B indicates, the surface potential of the conductive portions 21 is identical with the voltage from the bias applying means 9.

How the electric field between the sleeve 1*a* and the drum 3 is effected by such variations of the surface potential of the sleeve 1*a* will be described. This electric field differs from the insulative portions 22 to the conductive portions 21 of the sleeve 1*a* and from the image portions to the background of the drum 3.

Figure 7A:
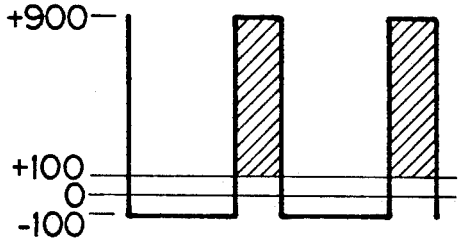
FIGS. 7A and 7B indicate respectively the variation of electric field in the conductive portions with respect to time occurring when the conductive portions face an image portion of a photoconductive drum, and the variation of the same occurring when the conductive portions face a non-image portion.
Figure 7B:
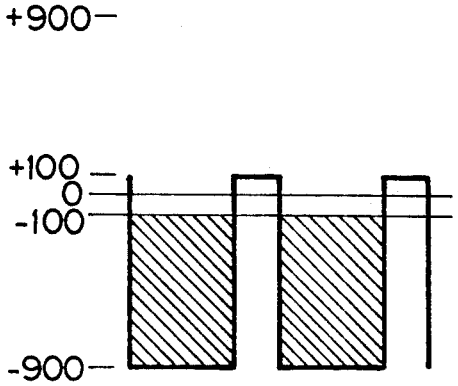
Figure 8A:
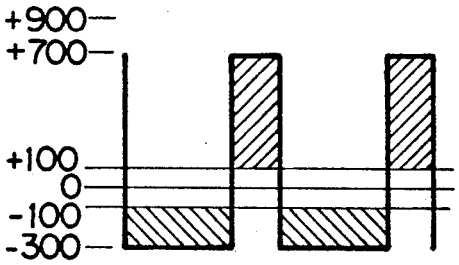
FIGS. 8A and 8B indicate respectively the variation of electric field in the insulative portions occurring when the insulative portions face the image portion on the drum, and the variation of the same occurring when the insulative portions face the non-image portion.
Figure 8B:
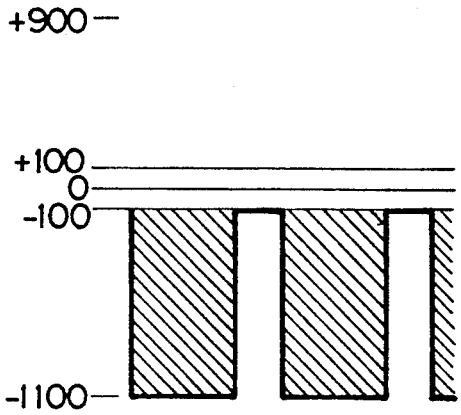

The electric field on the conductive portions 21 whose surface potential changes as plotted in FIG. 6B is shown in FIGS. 7A and 7B. When any of the conductive portions 21 faces the image portion (exposed portion) of the drum 3, the difference in potential between the two portions varies as plotted in FIG. 7A. On the other hand, when the conductive portion 21 faces the non-image portion (unexposed portion) of the drum 3, the difference in potential between the two portions varies as plotted in FIG. 7B. FIGS. 8A and 8B show electric fields on the insulative portions 22 whose surface varies as shown in FIG. 6A. Specifically, when any of the insulative portions 22 faces the image portion of the drum 3, the difference in potential between the two portions varies as plotted in FIG. 8A. When the insulative portion 22 faces the non-image portion of the drum 3, the potential difference varies as plotted in FIG. 8B.

The electric field of interest exerts an electrostatic force on the toner deposited on the surface of the sleeve 1*a* or on the surface of the drum 3. For this reason, the potential difference associated with the electric field of one direction in which the toner moves toward the drum 3 and the potential difference associated with the electric field of the other direction in which the toner moves toward the sleeve 1*a* are respectively represented by positive and negative in order to distinguish the directions of the electrostatic force. Further, the threshold level of +100 V of the potential difference causing the toner to move from the sleeve 1*a* to the drum 3 and the threshold level of −100 V of the electric field causing the toner to move from the drum 3 to the sleeve 1a, which were determined by experiments, are indicated by horizontal lines. The hatching indicates portions corresponding to the electric fields contributing to the transfer of the toner beyond the thresholds.

Presumably, when the toner on the conductive portion 21 of the sleeve 1a faces the image portion of the drum 3, it is moved toward the drum 3 when an electric field corresponding to the potential difference of +900 V is reached, as indicated by hatching in FIG. 7A. When the toner on the conductive portion 21 faces the non-image portion of the drum 3, it is presumed to move toward the sleeve 1a when the electric field of −900 V is reached, as indicated by hatching in FIG. 7B.

The insulative portion 22 of the sleeve 1a is originally charged to +200 V. Hence, when the toner on the insulative portion 22 faces the image portion of the drum 3, a negative electric field of −300 V and a positive electric field of +700 V appear alternately with each other, as indicated by hatching in FIG. 8A; presumably the toner moves from the sleeve 1a toward the drum 3 when the field is positive or moves from the drum 3 to the sleeve 1a when the field is negative. When the toner on the insulative portion 22 faces the non-image portion of the drum 3, it presumably moves from the drum 3 to the sleeve 1a when the electric field is −1100 V and does not move in a reciprocating motion, as indicated by hatching in FIG. 8B.

As stated above, in the specific example, the toner on the insulative portion 22 is subjected to positive and negative electric fields exceeding the respective thresholds, as shown in FIG. 8A. This is successful in preventing an excessive amount of toner from depositing on the portion 22. On the other hand, the toner on the conductive portion 21 exhibits a higher developing ability than the toner on the insulative portion 22, as represented by the electric field of FIG. 7A. In addition, the conductive portion 21 serves to uniformize the image density by suppressing the edge effect.

Experiments showed that images formed by the above conditions are free from irregular image densities and have high density and desirable tonality and line reproducibility.

It is noteworthy that the surface configurations of the sleeve 1a shown in FIGS. 5A and 5C were also found to realize images free from irregular image density distributions and having high density and desirable tonality and line reproducibility under the same conditions as the configuration shown in FIG. 5B.

While the embodiment has been shown and described as charging the insulative portions 22 to a polarity opposite to that of the toner, the insulative portions 22 may be charged to the same polarity as the toner by friction by suitable selecting the material constituting the surface of, for example, the toner supply roller 8. This is also successful in generating microfields due to the difference in potential between the insulative portions and the conductive portions. In this case, the toner will mainly deposit on the conductive portions.

Figure 9:
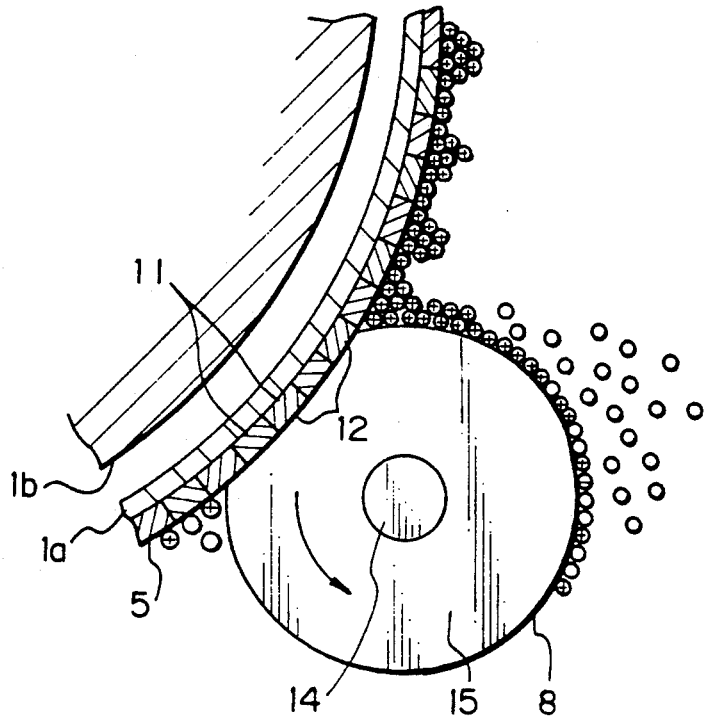
FIG. 9 is an enlarged section schematically showing dielectric members and toner particles representative of a modified form of the sleeve.
Figure 10:
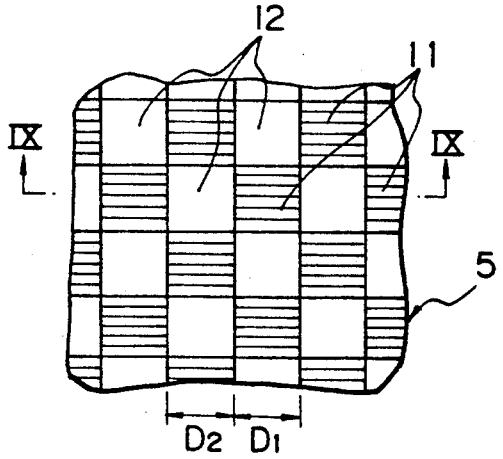
FIG. 10 is an enlarged plan view schematically showing the dielectric members of the sleeve shown in FIG. 9.
Figure 11:
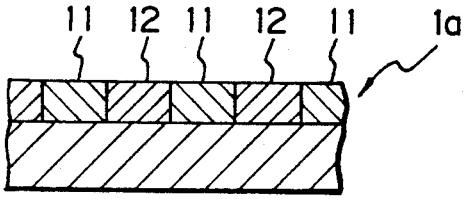
FIG. 11 is a section along line IX—IX of FIG. 10.
Figure 12:
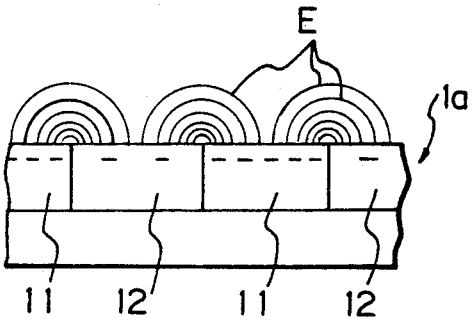
FIG. 12 shows electric lines of force representative of microfields generated in the vicinity of the surface of the sleeve shown in FIG. 9.

A reference will be made to FIGS. 9–12 for describing a developing apparatus using a modified form of the sleeve 1a. The apparatus to be described is essentially identical with the above embodiment except that the toner is charged to a positive polarity. As shown in FIG. 9, the sleeve 1a is made up of a base made of aluminum or similar nonmagnetic and conductive material, and medium resistance members 12 and high resistance members 11 affixed to the periphery of the base. FIG. 10 shows the sleeve with the dielectric members 11 and 12 in an enlarged view. FIG. 11 is a section along line IX—IX of FIG. 10. FIG. 12 shows electric lines of force representative of microfields developed in the vicinity of the surface of the sleeve 1a.

The resistivity of the medium resistance members 12 is selected to be higher than that of the conductive base surface (conductive roller 10 in the embodiment) and about $10^3$ Ωcm to $10^8$ Ωcm by way of example. The resistivity of the high resistance members 11 is selected to be even higher than that of the medium resistance members 12 and about $10^3$ Ωcm to $10^{15}$ Ωcm by way of example. Specifically, the resistance members 11 and 12 are each made of a dielectric substance having such a resistivity.

In FIG. 10, the high resistance members 11 are indicated by horizontal lines to be readily distinguished from the medium resistance members 12. As shown in FIGS. 9, 10 and 11, the two kinds of resistance members 11 and 12 are arranged in a regular pattern (or possibly in an irregular pattern) and appear on the surface of the sleeve 1a together.

The resistance members 12 and 11 may each be provided with any suitable shape. When the resistance members 12 and 11 are provided with a rectangular shape, as shown in FIG. 10, they may have one sides D1 and D2 dimensioned, for example, about 10 μm to 500 μm. The gist is that the sizes and resistivities of the resistance members 11 and 12 be suitably selected in such a manner as to intensify microfields, which will be described, to thereby deposit an optimum amount of toner on the sleeve 1a.

In the illustrative embodiment, the resistance members 11 and 12 are made of materials which will be charged to an opposite polarity to the toner, i.e., to a negative polarity by friction.

When the toner carrier is implemented as a belt, the resistance members 11 and 12 will be affixed to the surface of the belt in the above-described configuration.

On the other hand, the toner supply roller 8 contacting the sleeve 1a is made of a material which will charge the resistance members 11 and 12 to a opposite polarity to the toner, i.e., to a negative polarity on contacting them. In the arrangement shown in FIG. 9, the roller 8 is constituted by a conductive core member 14, and a cylindrical foam body (e.g. polyurethane foam) 15 surrounding the core member 14. The foam body 15 is pressed against the sleeve 1a by being elastically deformed. When use is made of such a roller 8, the foam body 15 may be made of a material which will charge the resistance members 11 and 12 to a negative polarity by friction. If desired, the foam body 15 is replaced with a fur brush or similar conventional implementation.

In the above construction, as the resistance members 11 and 12 contact the toner supply roller 8, they are charged to a negative polarity by friction. Even when an electrostatic residual image is left on the resistance members 11 and 12 moved away from the developing position, it is erased since the resistance members 11 and 12 are charged substantially to a saturation level due to friction thereof with the roller 8. As a result, the sleeve 1a is initialized.

As shown in FIG. 9, the toner being conveyed toward the sleeve 1a in contact with the surface of the toner supply roller 8 is charged to a positive polarity due to friction thereof with the roller 8. When such a toner is fed to the sleeve 1a, it is further charged to a positive polarity by the sleeve 1a and electrostatically deposited on the sleeve 1a. At this instant, although both of the resistance members 11 and 12 are negatively charged, a greater amount of charge is deposited on the resistance members 11 than on the resistance members 12 due to the difference in resistivity, as shown in FIG. 12. As a result, the surface potentials of the resistance members 11 and 12 are different from each other, generating microfields.

Since the number of resistance members 11 and 12 is almost infinite, an almost infinite number of microfields are developed on the surface of the sleeve 1*a* in a uniform distribution. Specifically, as indicated by a number of arcuate lines in FIG. 12, electric lines of force E extending from and returning to the sleeve 1*a* are formed in the space adjoining the surface of the sleeve 1*a*, generating microfields which are different in field gradient.

Since the surfaces of the resistance members 11 and 12 each has an extremely small area, as stated earlier, each microfield is also extremely small and noticeably intensified by the fringing effect or peripheral field effect. Such microfields cause the positively charged toner to be strongly attracted by the resistance members 11 and firmly retained on the sleeve 1*a* in a great amount. Specifically, the charged toner is firmly restrained by the microfields and held on the sleeve 1*a* along the electric lines of force E.

Again, the doctor blade 4, FIG. 1, selects part of the toner having been sufficiently charged and regulates the thickness thereof.

As shown in FIG. 12, the microfields are sometimes developed over the entire surface of the sleeve 1*a* and sometimes developed together with electric fields which are not closed. In any case, microfields are present and intensified to deposit a great amount of toner on the sleeve 1*a*.

If desired, the resistance members 11 and 12 may be charged to the same polarity as the toner so as to deposit a great amount of toner especially on the surfaces of the resistance members 12.

Furthermore, an arrangement may be made such that the medium resistance members 12 are substantially not charged while the high resistance members 11 are charged to a predetermined polarity, generating microfields therebetween. The gist is that at least the high resistance members 11 be charged to deposit the toner by the above-described principle.

When the sleeve 1*a* of this embodiment was located to face the drum 3 and applied with an alternating voltage as in the previous embodiment, it was also found to improve the negative characteristic and insure an image with high density and desirable tonality and line reproducibility. In addition, in the illustrative embodiment, the resistance members 11 and 12 appear on the surface of the sleeve 1*a*, but the conductive surface of the conductive roller does not appear. This surely suppresses the leak of charge between the drum 3 and the sleeve 1*a* which would disturb the latent image formed on the drum 3.

Figure 13:
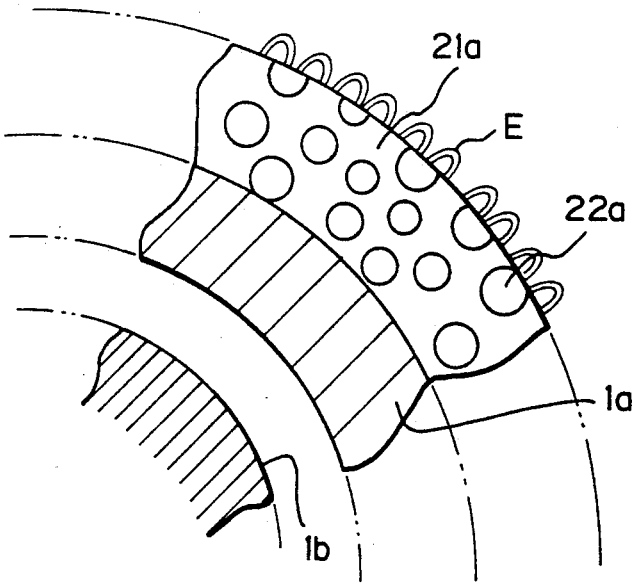
FIG. 13 is a fragmentary section showing another modified form of the sleeve.

FIG. 13 shows a developing apparatus using another modified form of the sleeve 1*a*. As shown, the sleeve 1*a* has a conductive base, and a surface layer surrounding the base and made of a conductive material 21*a* in which insulative particles 22*a* are dispersed. On the surface of the sleeve 1*a*, the insulative particles 22*a* appear together with the conductive portions constituted by the conductive material 21*a*.

How the toner deposits on the sleeve 1*a* is as follows. As shown in FIG. 1, part of the surface of the sleeve 1*a* moved away from the developing position is brought into contact with the toner supply roller 8. The toner supply roller 8 scrapes off the toner remaining on the non-image portions of the sleeve 1*a* mechanically and electrically. At this instant, the insulative portions are charged to a opposite polarity to the toner by friction. The charges deposited on the sleeve 1*a* and toner by the previous development are made constant and initialized by friction. The toner conveyed by the toner supply roller 8 is charged by friction and electrostatically deposited mainly on the insulative portions of the sleeve 1*a*. As shown in FIG. 2, the electric fields in the form of microfields are developed on the sleeve 1*a*, as shown in FIG. 2. Such electric fields with great field gradient cause the toner to deposit on the sleeve 1*a* in multiple layers. Then, the toner is firmly retained on the sleeve 1*a* since the microfields are closed.

While the embodiment has been shown and described as charging the insulative portions to a polarity opposite to that of the toner, the insulative portions may be charged to the same polarity as the toner by friction by suitably selecting the material constituting the surface of the toner supply roller 8. This is also successful in generating microfields due to the difference in potential between the insulative portions and the conductive portions. In this case, the toner will mainly deposit on the conductive portions.

The toner layer on the sleeve 1*a* is regulated in thickness by the doctor blade 4, FIG. 1, and then reaches the developing position. In the developing position, the electric fields between the sleeve 1*a* and the drum 3, FIG. 1, exert a greater electrode effect. As a result, the toner on the sleeve 1*a* is easily transferred to the drum 3 to develop a latent image.

The sleeve 1*a* of this embodiment will be described more specifically. The conductive material with the insulative particles dispersed therein may have a resistivity of less than $10^{12}$ Ωcm, preferably less than $10^{8}$ Ωcm. In practice, use may be made of an organic polymer to which an agent providing it with conductivity is added. The organic polymer may be resin (plastomer) or rubber (elastomer). The agent providing the polymer with conductivity may be metal powder, carbon black, conductive oxide, graphite, metal fibers or carbon fibers, by way of example.

When the conductive material is implemented by, among the above-mentioned organic polymers, elastomer, the surface layer of the sleeve 1*a* will have elasticity and easily contact the rigid drum 3. This will enhance easy contact development.

On the other hand, insulative particles are implemented by a material whose resistivity is higher than $10^{13}$ μcm, preferably higher than $10^{14}$ μcm. The mean particle size of such a material should preferably be greater than 30 μm. Particle sizes smaller than 30 μm would be difficult to generate microfields and, therefore, to maintain the toner and the charge stable. It is to be noted that the insulative particles may even be amorphous. For example, use may be made of alumina or similar inorganic particles or epoxy resin or similar organic particles. When the conductive material is implemented by the conductive elastomer, it is preferable to use elastomer as the insulative particles in order to enhance the low hardness. The insulative elastomer particles may be produced by any conventional method, e.g., one consisting of freezing elastomer by, for example, Dry ice and then pulverizing it, or one consisting of preparing an aqueous emulsion by use of, for example, a surface active agent and then hardening it.

Regarding the concentration, the insulative particles are added in an amount ranging from 10 Wt % to 200 Wt % to 100 Wt % of conductive material. The area of each insulative portion as measured on the surface of the sleeve 1*a* should preferably be 20% to 60%. The amount of insulative particles is adequately adjusted to set up such a range after the fabrication of the sleeve 1*a*.

The sleeve 1*a* of the embodiment is fabricated by, for example, adding the insulative particles to the conductive material by an ordinary dispersing method using a ball mill or the like, molding the resulting mixture on an aluminum or similar base by injection molding, extrusion molding, spray coating or dipping, and then polishing the surface of the sleeve. To enhance the bond between the conductive material and the conductive base, plastomer may be used, in which case the plastomer should preferably be conductive.

Specifically, 100 Wt % of conductive paint Electrodag 440 (available from Nihon Attison; containing 70% of solid and Ni particles), 50 Wt % of acryl resin (mean particle size of 80 μm), and 200 Wt % of diluent SB-1 (available from Nihon Attison) were mixed and applied to a SUS metallic roller by spray coating, dried at 80 degrees centigrade for 1 hour, and then polished to produce a sleeve having a 100 μm thick surface layer. When such a sleeve 1*a* was located to face the drum 3 and applied with the previously stated pulse voltage for development, the sleeve 1*a* was found to improve the negative characteristic and produce an image with high density and desirable tonality and line reproducibility.

In the embodiments shown and described, the developer carrier may be implemented as a belt in place of the sleeve. Further, the magnetic roller 1*b* which is a specific form of magnetic field generating means may be replaced with, for example, a permanent magnet accommodated in the sleeve 1*a* in such a manner as to form an electric field only around the doctor blade 4.

In summary, in accordance with the present invention, a magnetic developer is sufficiently charged by a charging means and then deposited on a developer carrier concentratedly and in a great amount by numerous microfields developed on the surface of the image carrier. Further, when the surface of the developer carrier reaches a regulating member, only a desired part of the developer is caused to form a layer having a predetermined thickness due to the balance between electrostatic attraction ascribable to the microfields and a magnetic force ascribable to magnetism generating means. Hence, a layer of sufficiently charged magnetic developer can be formed stably. The developer is transported to a developing position where the developer carrier faces an image carrier. At the developing position, the movement of the developer is controlled by electric fields determined by a relation of the potential of the image carrier, the potential of the developer carrier, and the voltage applying means. As a result, an adequate amount of developer is deposited on the image carrier in matching relation to an electrostatic latent image formed on the image carrier. This is successful in enhancing image density while preserving tonality and in preventing lines included in an image from thickening, whereby high quality images with desirable resolution are insured.

Various modifications will become possible for those skilled in the art after receiving the teachings of the present disclosure without departing from the scope thereof.

What is claimed is:

1. A developing apparatus facing an image carrier, the image carrier carrying an electrostatic latent image, and having a developer carrier facing said image carrier, the developer carrier carrying a magnetic developer and generating numerous microfields on a surface thereof, and voltage applying means for applying an alternating electric field to a developing position to apply a bias for development, said apparatus comprising:

charging means for charging a magnetic developer to a predetermined polarity;

a developer regulating member made of a magnetic material and facing a surface of the developer carrier;

magnetic field generating means provided in the developer carrier for generating a magnetic field at least at a position where said developer regulating member and the surface of the developer carrier face each other; and wherein the developer carrier comprises a conductive base and conductive portions constituted by said conductive base and dielectric portions affixed to said conductive base are formed together on a surface of said conductive base in a regular or irregular distribution, said charging means charging said dielectric portions to a predetermined polarity to generate the numerous microfields on said surface of said conductive base.

2. A developing apparatus facing an image carrier, the image carrier carrying an electrostatic latent image, and having a developer carrier facing said image carrier, the developer carrier carrying a magnetic developer and generating numerous microfields on a surface thereof, and voltage applying means for applying an alternating electric field to a developing position to apply a bias for development, said apparatus comprising:

charging means for charging a magnetic developer to a predetermined polarity;

a developer regulating member made of a magnetic material and facing a surface of the developer carrier;

magnetic field generating means provided in the developer carrier for generating a magnetic field at least at a position where said developer regulating member and the surface of the developer carrier face each other; and wherein the developer carrier comprises an elastic conductive material having a surface in which insulative particles are dispersed and wherein said insulative particles and portions constituted by said conductive material are formed together on said surface each with a small area, said charging means charging said insulative particles and said portions to a predetermined polarity to form the numerous microfields on said surface.

* * * * *